US005743760A

United States Patent [19]

Inaba et al.

[11] Patent Number: 5,743,760

[45] Date of Patent: Apr. 28, 1998

[54] CONNECTOR ENGAGEMENT DETECTING DEVICE

[75] Inventors: Shigemitsu Inaba; Etsuro Suzuki; Akira Maeda; Tomoyuki Hotta, all of Shizuoka, Japan

[73] Assignee: Yazaki Corporation, Tokyo, Japan

[21] Appl. No.: 723,880

[22] Filed: Sep. 23, 1996

[30] Foreign Application Priority Data

Sep. 25, 1995 [JP] Japan ..... 7-245963
Oct. 20, 1995 [JP] Japan ..... 7-272771

[51] Int. Cl.[6] ..... H01R 3/00

[52] U.S. Cl. ..... 439/489

[58] Field of Search ..... 439/488, 489, 439/188

[56] References Cited

U.S. PATENT DOCUMENTS 5,562,486 10/1996 Saijo et al. ..... 439/489

FOREIGN PATENT DOCUMENTS 6-310215 11/1994 Japan ..... H01R 13/64

*Primary Examiner*—Gary F. Paumen
*Assistant Examiner*—Yong Ki Kim
*Attorney, Agent, or Firm*—Sughrue, Mion, Zinn, Macpeak & Seas, PLLC

[57] ABSTRACT

A connector assembly comprises a first connector housing with a flexible locking arm, and a second connector housing having an engaging section which is provided for the flexible locking arm. In the first connector housing, a shorting contactor including an elastic contact plate is set in a displacement permitting space provided for the flexible locking arm in such a manner that the elastic contact plate is displaced in association with the displacement of the flexible locking arm. In the second connector housing, a pair of engagement detecting metal terminals are provided in confrontation with the shorting contactor. When the first and second connector housings are incompletely engaged with each other, the shorting contactor is not contact with the engagement detecting metal terminals by the displacement of elastic contact plate which is due to the displacement of the flexible locking arm.

12 Claims, 18 Drawing Sheets

CONNECTOR ENGAGEMENT DETECTING DEVICE

BACKGROUND OF THE INVENTION

1. Field of the Invention

This invention relates to a connector assembly comprising male and female connectors which is, for instance, used for connection of wire harnesses in a motor vehicle, and more particularly to a connector engagement detecting device having means for detecting whether or not the male and female connectors have been completely engaged with each other.

2. Description of the Related Art

In FIG. 29, reference character A' designates a male connector housing; and B', a female connector housing for a printed circuit board. Those connector housings A' and B' are made of synthetic resin respectively.

The male connector housing A' has a plurality of terminal accommodating chambers 10 into which female metal terminals C' are fixedly inserted (cf. FIG. 31), while in a body 12 of the female connector housing B' (hereinafter referred to as "housing body 12", when applicable) a plurality of pin-type male metal terminals D' are arranged while being supported by a rear wall 11 thereof.

The male connector housing A' has a recess 13 in the upper surface. In the recess 13, a cantilevered flexible locking arm 14 having a raised base end portion 14*a* at the front end portion is provided in such a manner that it is extended backwardly. The flexible locking arm 14 includes a locking protrusion 14*b* formed on the upper surface of its middle, and an unlocking depressing portion 14*c* at its free end. On the other hand, at the middle of the front end portion of an upper wall 15 of the female connector housing B', the housing B' includes an engaging frame 16 which is provided for the flexible locking arm 14, and a locking hole 16*a* which is provided for the locking protrusions 14*b*.

When the male and female connector housings A' and B' are engaged with each other, the male and female metal terminals C' and D' are brought into contact with each other. In this operation, the locking protrusion 14*b* of the flexible locking arm 14 is abutted against the front end of the engaging frame 16, so that the flexible locking arm 14 is bent downwardly through a displacement permitting space $R_1$ provided below the arm 14. Thereafter, the locking protrusion 14*b* is engaged with the locking hole 16*a*, so that the flexible locking arm 14 thus bent is restored, thus completely locking the male and female connector housings A' and B' to each other.

In the housing body 12 of the female connector housing B', a supporting frame 17 is extended forwardly from the rear wall 11 of the housing body 12 in correspondence to the engaging frame 16. The supporting frame 17 is made up of a horizontal plate 17*a*, and a partition plate 17*b* set upright on the horizontal plate 17*a* at the middle; that is, the supporting frame 17 is in the form of the character T in section. A pair of engagement detecting pin-type metal terminals D" are provided on both sides of the partition plate 17*b*, respectively, in such a manner that they are extended through the rear wall 11. The engagement detecting pin-type metal terminals D" and the supporting frame 17 are extended more forwardly than the aforementioned pin-type metal terminals D'.

On the other hand, in the male connector housing A', an opening 18 substantially T-shaped in section, into which the supporting frame 17 is inserted, is formed in parallel with the flexible locking arm 14 in such a manner that it is extended backwardly. Furthermore, in the male connector housing A', a supporting chamber 20 for a shorting contactor 19 is provided below the opening 18 in such a manner that it is opened forwardly.

The shorting contactor 19 is secured with its base plate 19*a* and cover plates 19*b* fitted in the supporting chamber 20. As shown in FIGS. 30 and 31, the shorting contactor 19 includes a pair of elastic contact pieces 19*c* which are extended backwardly. The elastic contact pieces 19*c* include shorting contacts $19c_1$, which are confronted through a space $R_2$ with a bottom surface 13*a* of the aforementioned recess 13 from inside. The shorting contactor 19 further includes driven portions 19*d*, which enter the recess 13 through cuts $13a_1$ formed in the bottom surface 13*a* of the recess 13, thus abutting against the lower end of the unlocking depressing portion 14*c* of the flexible locking arm 14 (cf. FIG. 31). The pair of elastic contact pieces 19*c* have a slit 19*e* between them, thus being able to elastically displace independently of each other. Hence, even if the pair of engagement detecting pin-type metal terminals D", which are to be shorted, are shifted vertically from each other, they can be sufficiently electrically connected to each other with the shorting contactor.

In engaging the male and female connector housings A' and B' with each other, first the supporting frame 17 and the engagement detecting pin-type metal terminals D" are inserted into the opening 18 as shown in FIG. 32. As the engagement of the two housings A' and B' is advanced, the front ends of the supporting frame 17 and the engagement detecting pin-type metal terminals D" enter the aforementioned space $R_2$, while the locking protrusion 14*b* engages with the lower portion of the engaging frame 16, so that the flexible locking arm 14 is flexibly displaced through the displacement permitting space $R_1$. As the flexible locking arm 14 is displaced in the above-described manner, the elastic contact pieces 19*c* of the shorting contactor 19 are displaced in such a manner that the space $R_2$ is increased, and therefore the engagement detecting pin-type metal terminals D" are not in contact with the shorting contactor 19 as shown in FIG. 33. When the male and female connector housings A' and B' have been completely engaged with each other, the flexible locking arm 14 is restored, while the elastic contact pieces 19*c* of the shorting contactor 19 are also restored, so that the shorting contacts $19c_1$ are brought into contact with the engagement detecting pin-type metal terminals D", thus activating a detecting circuit as shown in FIG. 34.

In the above-described connector assembly, the shorting contactor operating in association with the flexible locking arm, being spaced from the flexible locking arm, is positioned inside the connector housing. This feature results in an increase in longitudinal dimension of the connector assembly, thus making the assembly bulky.

SUMMARY OF THE INVENTION

In view of the foregoing, an object of the invention is to provide a connector engagement detecting device in which the shorting contactor is provided near the flexible locking arm to make the connector housing compact.

In order to achieve the above object, the invention provides a connector engagement detecting device comprising: a first connector housing having a flexible locking arm; a shorting contactor set in a displacement permitting space provided for the flexible locking arm in the first connector housing, the shorting contactor including an elastic contact plate which is displaced in association with displacement of the flexible locking arm; a second connector housing having an engaging section provided for the flexible locking arm; and a pair of engagement detecting metal terminals provided in the second connector housing in confrontation with the shorting contactor, wherein when the first and second connector housings are incompletely engaged with each other, the shorting contactor is prevented from being in contact with the engagement detecting metal terminals by displacement of the elastic contact plate of the shorting contactor which is due to the displacement of the flexible locking arm.

DETAILED DESCRIPTION OF THE PREFERRED EMBODIMENTS

First Embodiment

Figure 1:
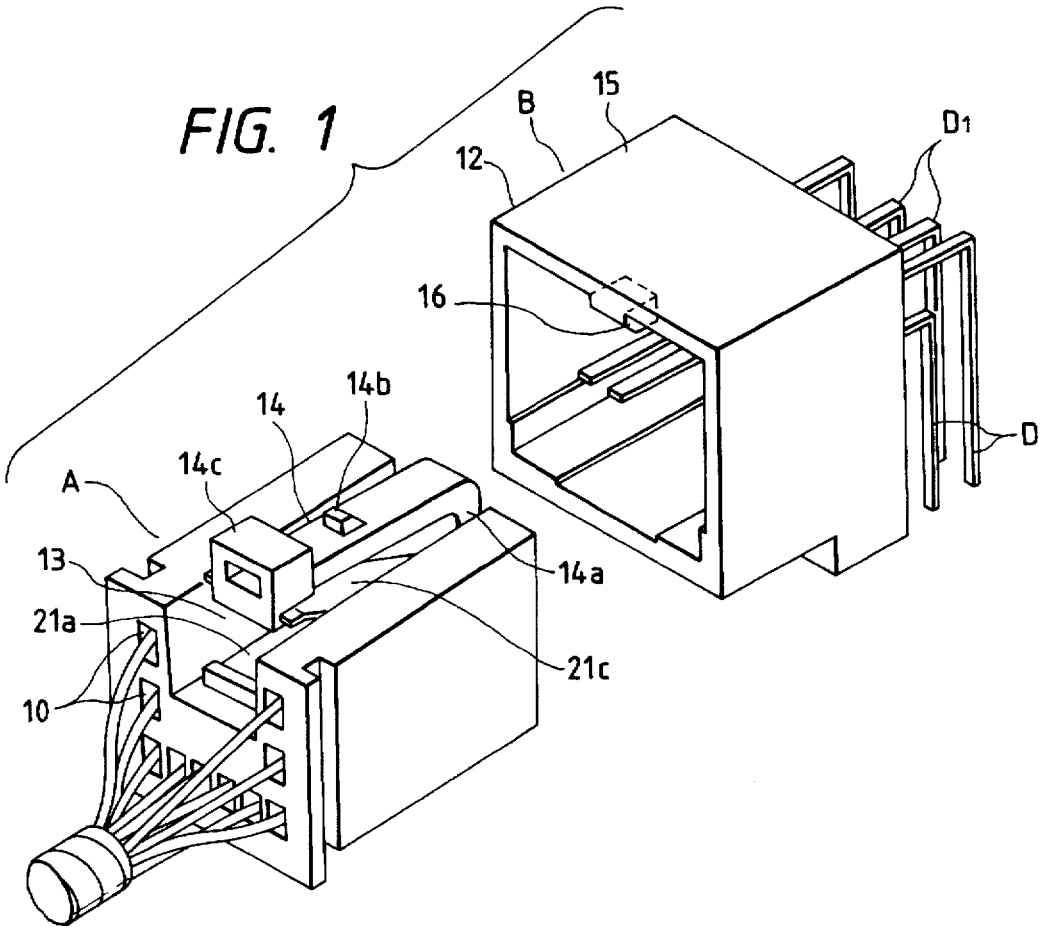
FIG. 1 is an exploded perspective view of an example of a connector assembly comprising male and female connector housings, which constitutes a first embodiment of the invention.

In FIG. 1, reference character A designates a male connector housing; and B, a female connector housing, which form a connector assembly. Those connector housings A and B are made of synthetic resin respectively.

Figure 5:
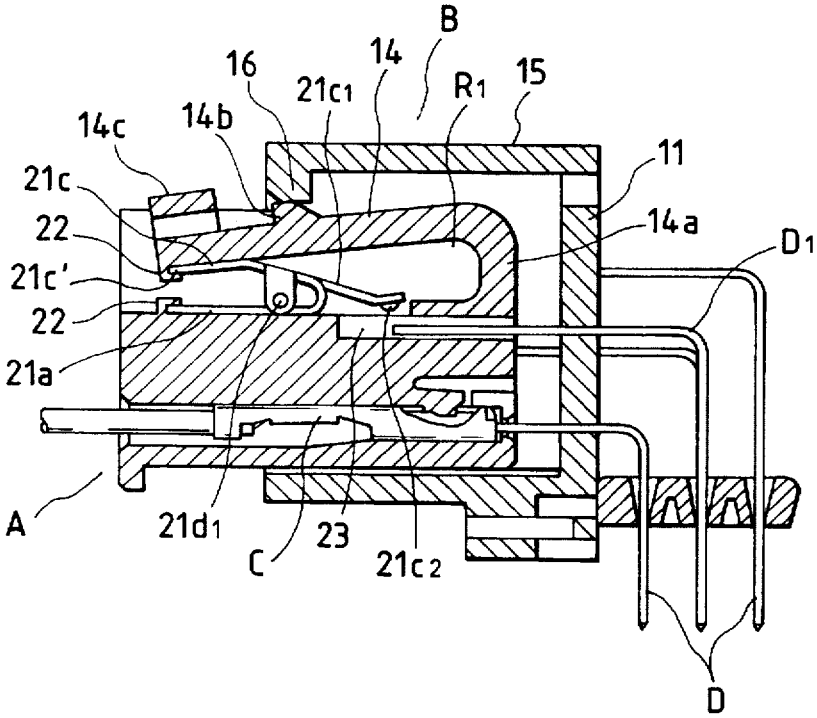
FIG. 5 is a sectional view showing the male and female connector housings which are incompletely engaged with each other in the first embodiment.

The male connector housing A has a plurality of terminal accommodating chambers 10, into which female metal terminals C are fixedly inserted (cf. FIG. 3), while the female connector housing B includes a housing body 12 into which pin-type male metal terminals D are inserted while being supported by the rear wall 11 of the housing (cf. FIG. 5).

The male connector housing A has a recess 13 in its upper surface. In the recess 13, a cantilevered flexible locking arm 14 having a raised base end portion **14*a* at the front end portion is provided in such a manner that it is extended backwardly. The flexible locking arm 14 includes a locking protrusion 14*b* formed on the upper surface of its middle, and an unlocking depressing portion 14***c* all its free end. On the other hand, at the middle of the front end portion of the inner surface of an upper wall 15 of the female connector housing B, the housing B includes an engaging member 16. The engaging member 16 is provided for the locking protrusion 14*b* of the flexible locking arm 14.

Figure 2:
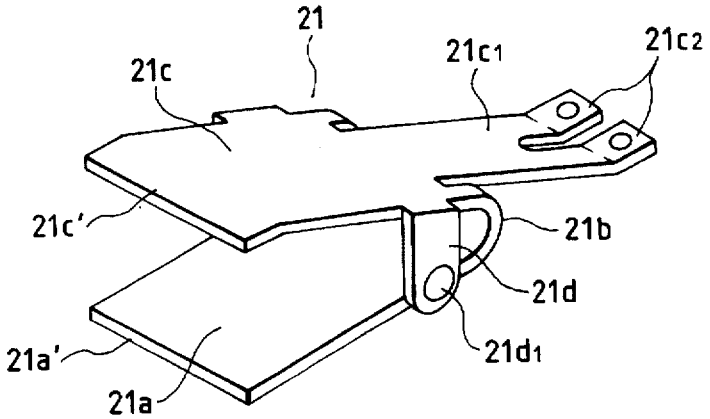
FIG. 2 is a perspective view of a shorting contactor in the first embodiment.

In the recess 13 of the male connector housing A, a displacement permitting space R is provided below the flexible locking arm 14, and a shorting contactor 21 is disposed in the space R (cf. FIG. 3). The shorting contactor 21, as shown in FIG. 2, includes: a bent portion 21*b;* and an elastic contact plate 21*c* and a base plate 21*a* which are extended from both ends of the bent portion 21*b*. The elastic contact plate 21*c* includes a contact plate portion $21c_1$ which is cut and raised so that it is extended over the bent portion 21*b*. The contact plate portion $21c_1$ has a pair of shorting contacts $21c_1$ at the end. The elastic contact plate 21*c* has a pair of mounting ears 21*d* at the base end on both sides thereof in such a manner that the mounting ears 21*d* are extended towards the base plate 21*a*. The mounting ears 21*d* have fulcrum protrusions $21d_1$, respectively.

Figure 3:
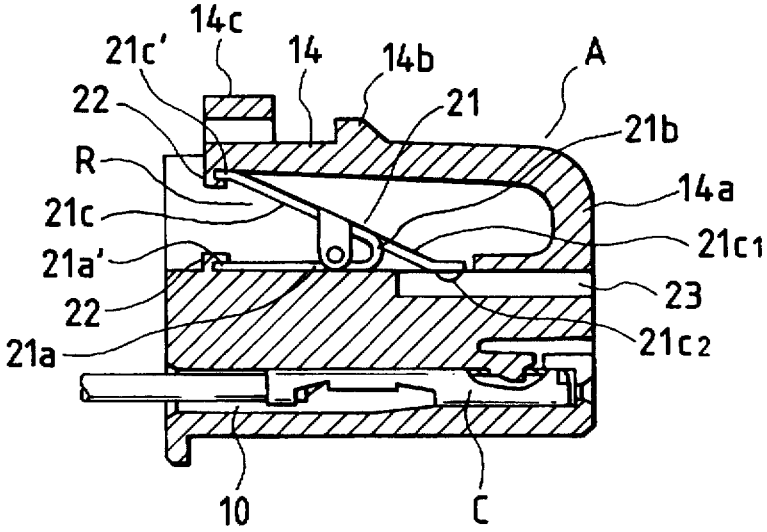
FIG. 3 is a sectional view of the male connector housing in the first embodiment.
Figure 4:
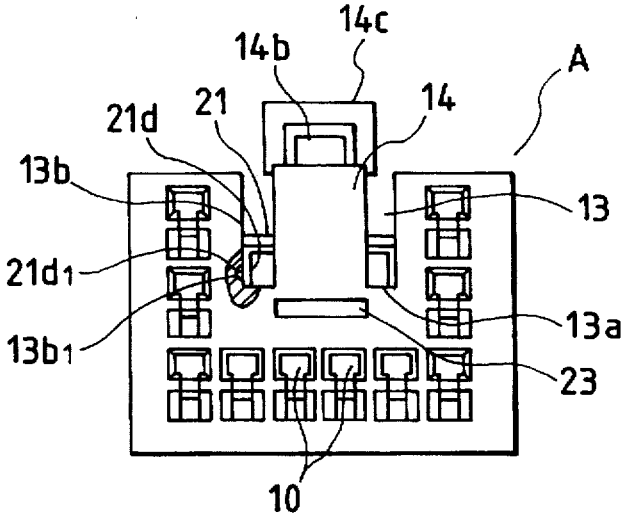
FIG. 4 is a front view, with parts cut away, of the male connector housing in the first embodiment.

As shown in FIGS. 3 and 4, the shorting contactor 21 is arranged in the displacement permitting space R of the flexible locking arm 14 with the bent portion 21*b* faced towards the raised base end portion 14*a* of the flexible locking arm 14. More specifically, the base plate 21*a* is pressed against the bottom surface 13*a* of the recess 13, while the elastic contact plate 21*c* is pressed against the inner surface of the flexible locking arm 14, and their free ends 21*a*' and 21*c*' are engaged with locking frames 22 of the male connector housing, respectively. The fulcrum protrusions $21d_1$ of the mounting ears 21*d* are engaged with pivotally supporting recesses $13b_1$ formed in the side walls 13*b* of the recess 13, respectively. Under this condition, the shorting contacts $21c_2$ appears in an accommodating chamber 23 formed below the raised base end portion 14*a*.

The accommodating chamber 23 is opened in the front end face of the male connector housing A. In the housing body 12 of the female connector housing B, a pair of engagement detecting metal terminals $D_1$ are extended towards the accommodating chamber 23 while being supported by the rear wall 11 of the housing body 12.

In engaging the male and female connector housings A and B, the engagement detecting metal terminals $D_1$ enter the accommodating chamber 23. When the connector housings A and B are incompletely engaged with each other, the locking protrusion 14*b* is engaged with the engaging member 16 of the upper wall 15, so that the flexible locking arm 14 is flexibly displaced downwardly. As the flexible locking arm 14 is displaced in this manner, the elastic contact plate 21*c* is swung about the fulcrum protrusions $21d_1$, so that the shorting contacts $21c_2$ come out of the accommodating chamber 23; that is, the engagement detecting metal terminals $D_l$ are not in contact with the shorting contactor 21 (cf. FIG. 5).

Figure 6:
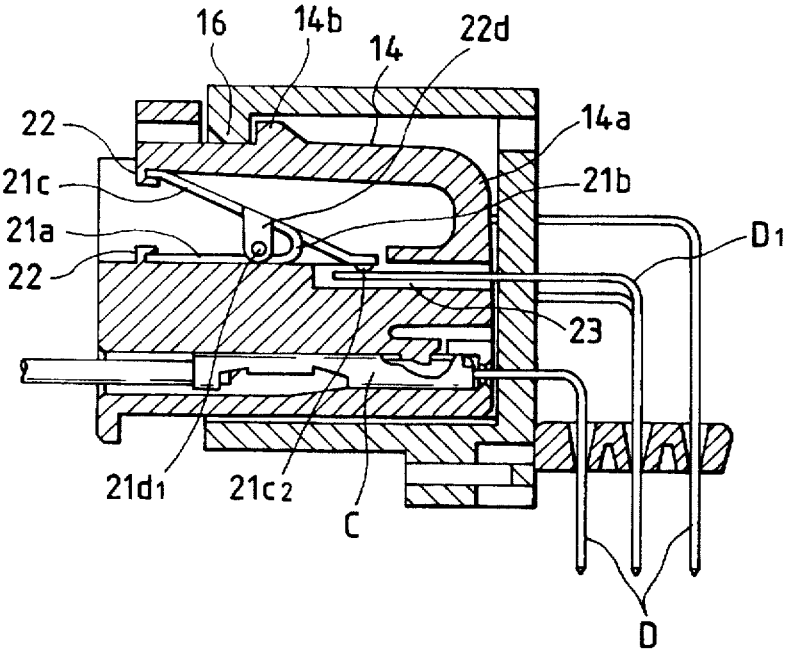
FIG. 6 is a sectional view showing the male and female connector housings which have been completely engaged with each other in the first embodiment.
Figure 7:
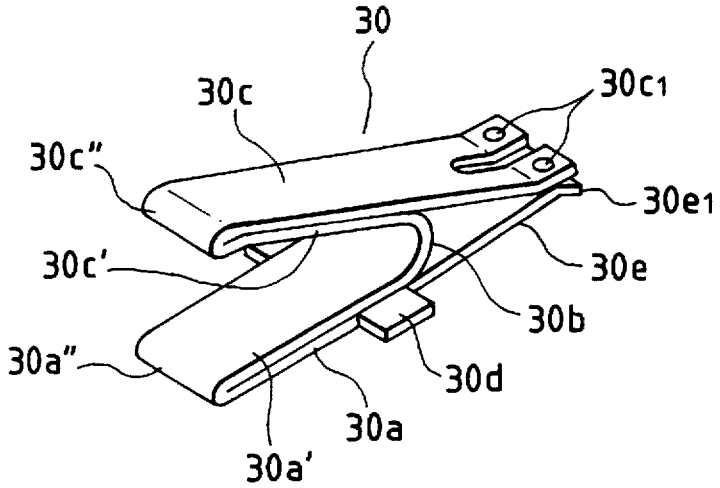
FIG. 7 is a perspective view of a shorting contactor in another example of the connector assembly, which constitutes a second embodiment of the invention.

When the male and female connector housings A and B are completely engaged with each other, the flexible locking arm 14 is restored, and the elastic contact plate 21*c* is also restored, so that the shorting contacts $21c_2$ are brought into contact with the pair of engagement detecting metal terminals $D_1$, respectively, to activate the detecting circuit (cf. FIG. 6).

Second Embodiment

FIGS. 7 through 10 show another example of the connector assembly comprising male and female connector housings, which constitutes a second embodiment of the invention.

In the second embodiment, a shorting contactor 30 is formed by bending a belt-shaped plate zigzag. More specifically, the shorting contactor 30 includes: a base plate 30*a;* a folded plate 30*a*' which is extended from one end of the base plate 30*a* in such a manner that it is folded over the plate 30*a;* a bent portion 30*b* which is extended from the folded plate 30*a*' and suitably bent; an elastic plate 30*c*' extended from the bent portion 30*b* in such a manner that it is laid over the folded plate 30*a*'; and an elastic contact plate 30*c* which is extended from the end of the elastic plate 30*c*' and folded over the plate 30*c*'. The elastic contact plate 30*c* has a pair of shorting contacts $30c_1$ at the end portion. The base plate 30*a* has a pair of mounting protrusions 30*d* on both sides thereof, and the free end portion of the base plate 30*a* which is extended beyond the bent portion 30*b* is a clamping plate 30*e* whose end portion is formed into a receiving portion $30e_1$ which is bent outwardly and confronted with the shorting contacts $30c_1$.

Figure 8:
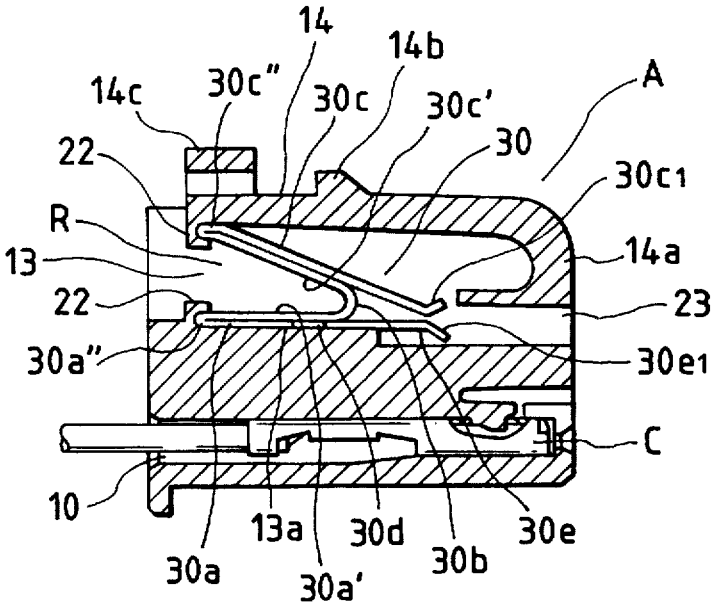
FIG. 8 is a sectional view showing the shorting contactor which is set in the male connector housing in the second embodiment.
Figure 9:
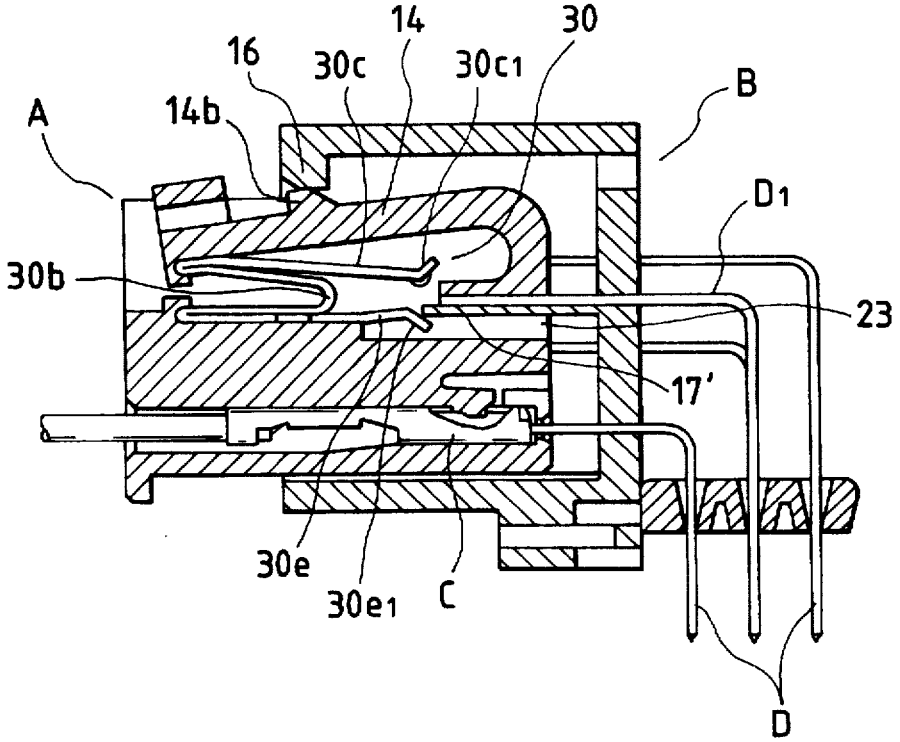
FIG. 9 is a sectional view showing the male and female connector housings which are incompletely engaged with each other in the second embodiment.
Figure 10:
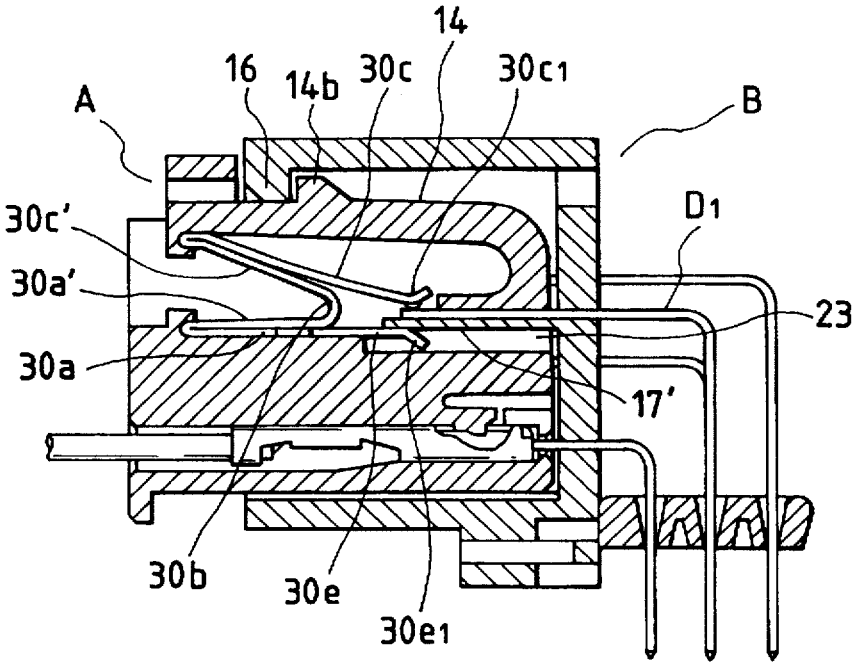
FIG. 10 is a sectional view showing the male and female connector housings which have been completely engaged with each other in the second embodiment.
Figure 11:
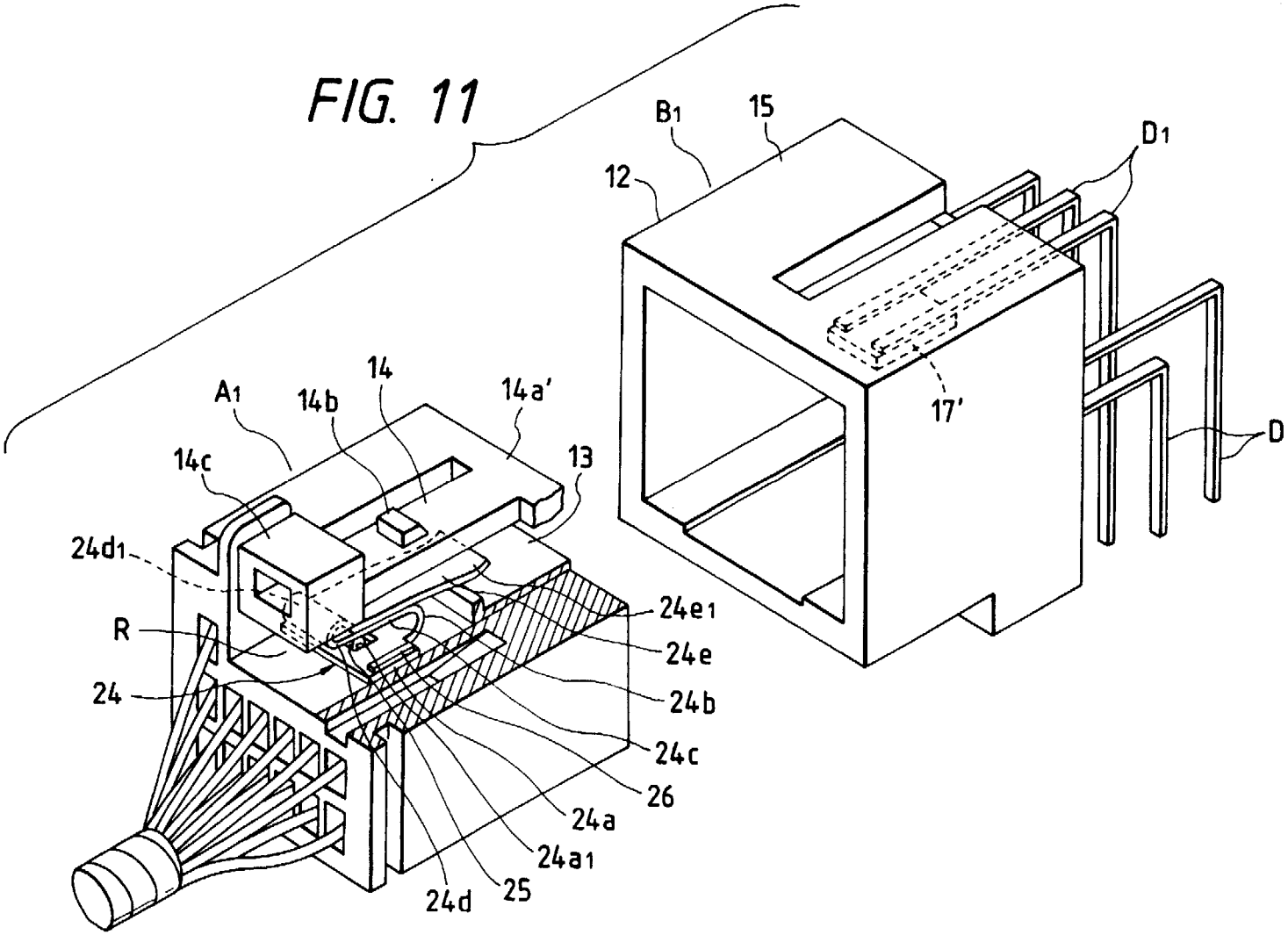
FIG. 11 is an exploded perspective view of another example of the connector assembly comprising male and female connector housings, which constitutes a third embodiment of the invention.
Figure 12:
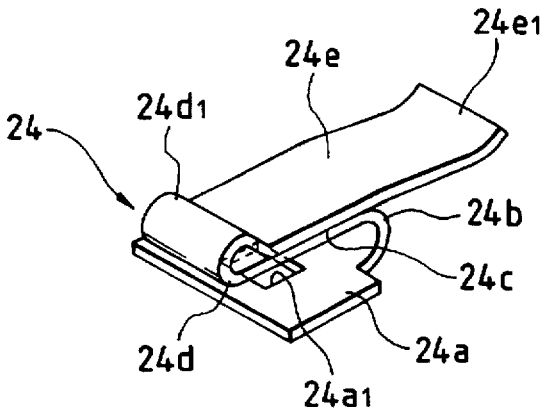
FIG. 12 is a sectional view of a shorting contactor in the third embodiment.
Figure 13:
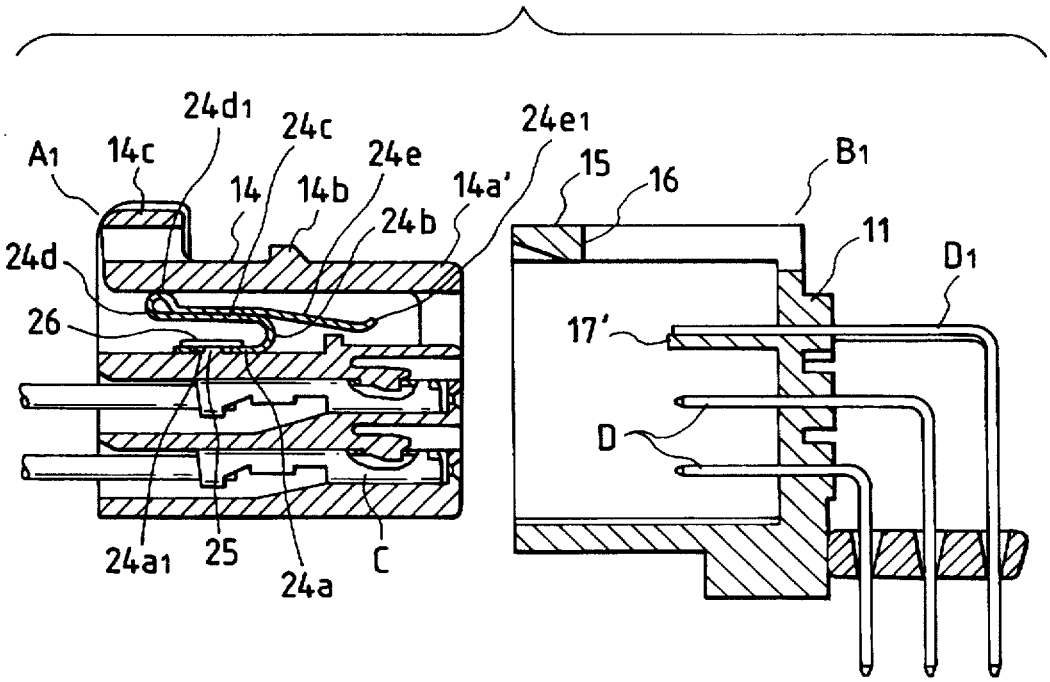
FIG. 13 is a sectional view of the male and female connector housings in the third embodiment.
Figure 14:
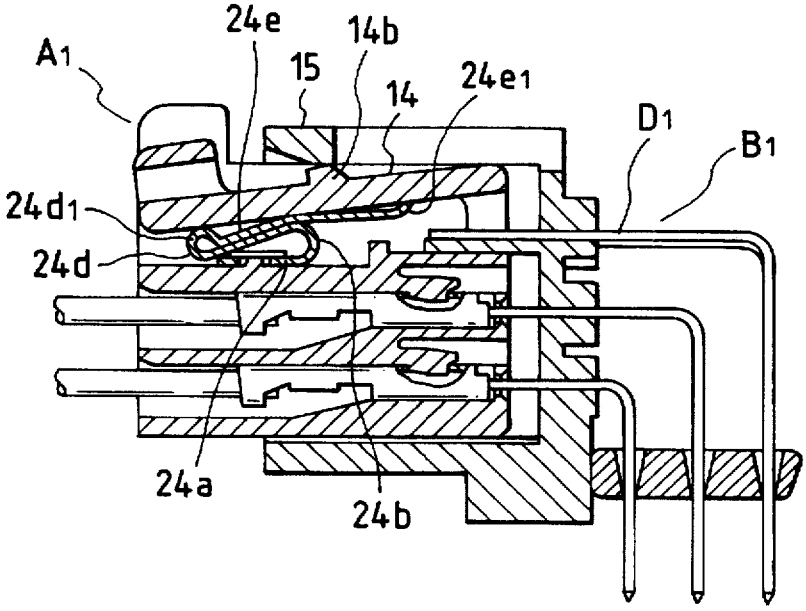
FIG. 14 is a sectional view showing the male and female connector housings which are incompletely engaged with each other in the third embodiment.
Figure 15:
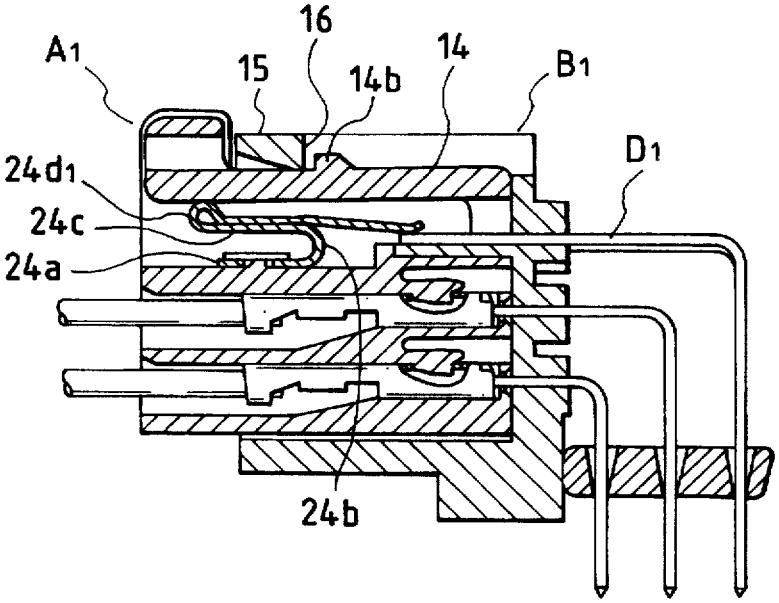
FIG. 15 is a sectional view showing the male and female connector housings which have been completely engaged with each other in the third embodiment.
Figure 16:
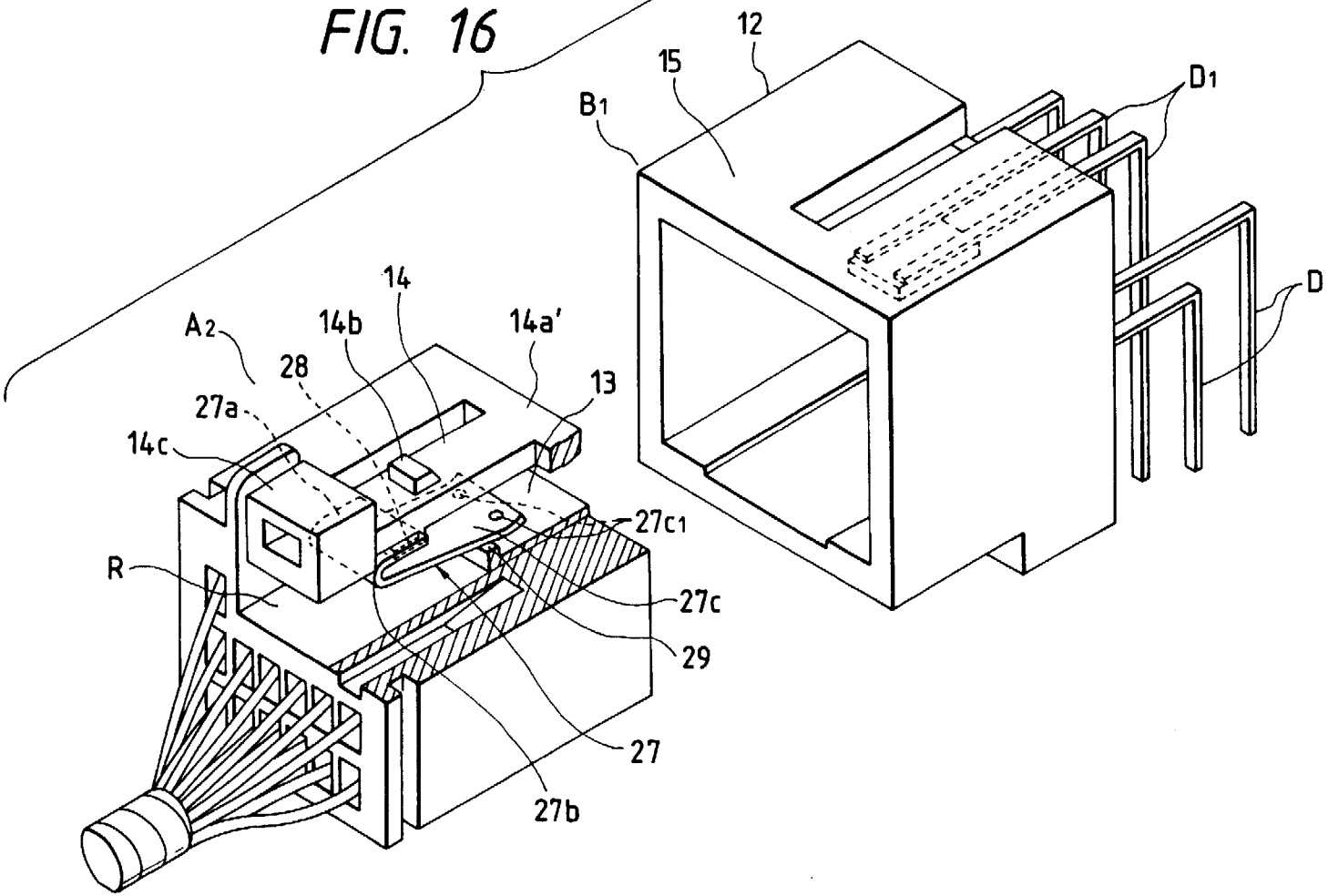
FIG. 16 is an exploded perspective view of another example of the connector assembly comprising male and female connector housings, which constitutes a fourth embodiment of the invention.
Figure 17:
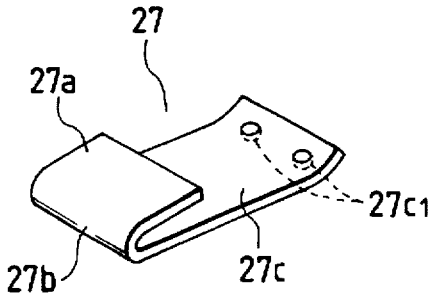
FIG. 17 is a sectional view of a shorting contactor in the fourth embodiment.
Figure 18:
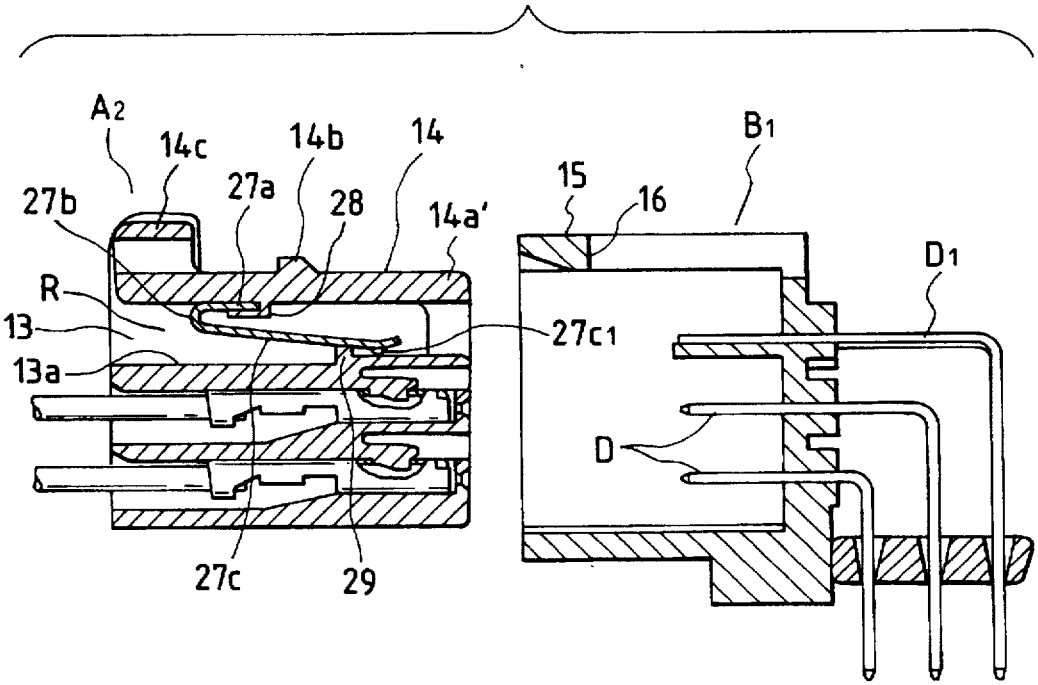
FIG. 18 is a sectional view of the male connector housing in the fourth embodiment.
Figure 19:
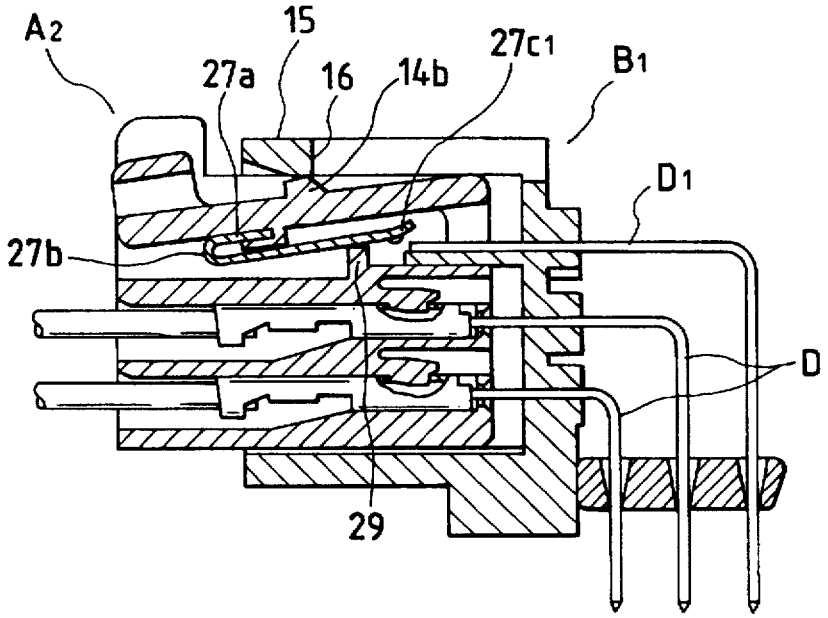
FIG. 19 is a sectional view showing the male and female connector housings which are incompletely engaged with each other in the fourth embodiment.

As shown in FIG. 8, the shorting contactor 30 is arranged in the displacement permitting space R of the flexible locking arm 14 with the bent portion 30*b* faced towards the raised base portion 14*a* of the flexible locking arm 14. More specifically, the base plate 30*a* is pressed against the bottom surface 13*a* of the recess 13, while the elastic contact plate 30*c* is pressed against the inner surface of the flexible locking arm 14, and their free ends 30*a*" and 30*c*" are engaged with the locking frame 22 of the male connector housing, respectively. In addition, the mounting protrusions 30*d* of the base plate 30*a* are engaged with engaging frames (not shown) formed on the bottom surface 13*a* of the recess 13. Under this condition, the receiving portion $30e_1$ which is the end portion of the clamping plate 30*e* enters the accommodating chamber 23 which is formed below the raised base portion 14*a* of the flexible locking arm 14, and the shorting contacts $30c_1$ are abutted against the clamping plate 30*e*.

The accommodating chamber 23 is opened in the front surface of the male connector housing A. In the body 12 of the female connector housing B, a pair of engagement detecting metal terminals $D_1$ are extended towards the accommodating chamber 23 while being supported by an electrically insulating supporting plate 17' which is extended from the rear wall 11 of the housing body 12.

In engaging the male and female connector housings A and B, the supporting plate 17' and the engagement detecting metal terminals $D_1$ enter the accommodating chamber 23. When the connector housings are incompletely engaged with each other, the locking protrusion 14*b* is engaged with the engaging member 16 of the upper wall 15, so that the flexible locking arm 14 is flexibly displaced downwardly. As the flexible locking arm 14 is displaced in this manner, the elastic contact plate 30*c* is displaced, so that the shorting contacts $30c_1$ come out of the accommodating chamber 23, and the supporting plate 17' protruded ahead of the engagement detecting metal terminals $D_1$ is abutted against the receiving portion $30e_1$; that is, the engagement detecting metal terminals $D_1$ are not in contact with the shorting contactor 30 (cf. FIG. 9).

When the male and female connector housings A and B have been completely engaged with each other, the flexible locking arm 14 is restored, and the elastic contact plate 30 is also restored, so that shorting contacts $30c_1$ are brought into contact with the engagement detecting metal terminals $D_1$, thus activating the detecting electrical circuit. This state of contact is stably held with the aid of the clamping plate 30*e* (cf. FIG. 10).

Third Embodiment

FIGS. 11 through 15 show a third embodiment of the invention.

In a recess 13 formed in the upper surface of a male connector housing $A_1$, a flexible locking arm 14 is extended backwardly which is cantilevered with a bridging base end portion 14*a*' provided at the front end of the connector housing, and a shorting contactor 24 is provided in a displacement permitting space R provided below the flexible locking arm 14. The shorting contactor 24 is formed by using a piece of elongated plate. More specifically, the shorting contactor 24 includes: a base plate 24*a;* a first bent portion 24*b* which is extended from the base plate 24*a* and suitably bent; an elastic plate 24*c* which is extended from the first bent portion 24*b* in such a manner that it is laid over the base plate 24*a;* a second bent portion 24*d* which is extended from the elastic plate 24*c* and suitably bent; and an elastic contact plate 24*e* which is extended from the second bent portion 24*d* and folded over the elastic plate 24*c*. The second bent portion has a raised driven portion $24d_1$. The free end portion of the elastic contact plate 24*e* which is extended beyond the second bent portion 24*d* is formed into a shorting contact $24e_1$.

The shorting contactor 24 is set in the displacement permitting space R of the flexible locking arm 14 as follows: The base plate 24*a* has a locking hole $24a_1$. The locking hole $24a_1$ is engaged with an engaging protrusion 25 formed on the bottom surface 13*a* of the recess 13, and its both side portions are engaged with locking frames 26. Furthermore, the raised driven portion $24d_1$ is abutted against the inner surface of the flexible locking arm 14*c* near the unlocking depressing portion 14*c*, while the shorting contact $24e_1$ of the elastic contact plate 24*e* is faced towards the bridging base end portion 14*a*'.

In a body 12 of a female connector housing $B_1$, a pair of engagement detecting metal terminals $D_1$ are supported by a supporting plate 17' which is extended from a rear wall of the housing body 12, in such a manner that they are confronted with the displacement permitting space R through the front end of the female connector housing $B_1$.

In engaging the male and female connector housings $A_1$ and $B_1$ with each other, first the engagement detecting metal terminals $D_1$ enter the displacement permitting space R. When the housings $A_1$ and $B_1$ are incompletely engaged with each other, the locking protrusion 14*b* is abutted against the end of the upper wall 15, so that the flexible locking arm 14 is flexibly displaced downwardly. As the flexible locking arm 14 is displaced in this manner, the elastic plate 24*c* and the elastic contact plate 24*e* are swung with the bent portion 24*b* as a fulcrum, so that the shorting contact $24e_1$ is raised. Thus, in this case, the engagement detecting metal terminals $D_1$ are not in contact with the shorting contactor 24 (cf. FIG. 14).

When the male and female connector housings $A_1$ and $B_1$ have been completed engaged with each other, the flexible locking arm 14 is restored, and the elastic plate 24*c* and the elastic contact plate 24*e* are also restored. As a result, the shorting contact $24e_1$ is brought into contact with the pair of engagement detecting metal terminals $D_1$, thus activating the detecting electrical circuit (cf. FIG. 15).

Fourth Embodiment

FIGS. 16 through 20 show a fourth embodiment of the invention.

Similarly as in the case of the above-described third embodiment, in a recess 13 formed in the upper surface of a male connector housing $A_2$, a flexible locking arm 14 is provided which is cantilevered with a bridging base end portion 14*a*' provided at the front end of the connector housing in such a manner that it is extended backwardly, and a shorting contactor 27 is provided in a displacement permitting space R provided below the flexible locking arm 14. The shorting contactor 27 is formed by using a piece of elongated plate. More specifically, the shorting contactor 27 includes: a base plate 27*a;* a bent portion 27*b* which is extended from the base late 27*a* and suitably bent; and an elastic contact plate 27*c* which is extended from the bent portion 27*b* and laid over the base plate 27*a*. The elastic contact plate 27*c* has shorting contacts $27c_1$ on its free end portion.

The shorting contactor 27 is set in the displacement permitting space R of the flexible locking arm 14 as follows: The base plate 27*a* is engaged with a locking frame 28 formed on the inner surface of the flexible locking arm 14, and the side of the free end portion of the elastic contact plate 27*c* which is opposite to the side where the shorting contacts $27c_1$ are formed, is abutted against a rib-shaped supporting member 29 which is formed on the bottom surface 13*a* of the recess 13. The female connector housing $B_1$ is equal in structure to the one in the above-described third embodiment.

In engaging the male and female connector housings $A_2$ and $B_1$ with each other, first the engagement detecting metal terminals $D_1$ enter the displacement permitting space R. When the connector housings are incompletely engaged with each other, in association with the displacement of the flexible locking arm 14, the elastic contact plate 27*c* is swung about the rib-shaped fulcrum 29, so that the shorting contacts $27c_1$ are raised; that is, the engagement detecting terminals $D_1$ are not in contact with the shorting contactor 27 (cf. FIG. 19).

Figure 20:
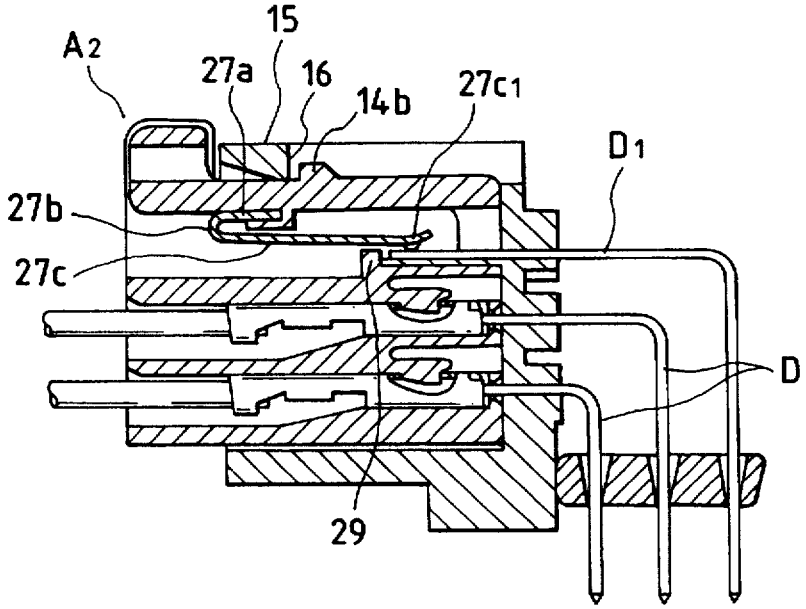
FIG. 20 is a sectional view showing the male and female connector housings which are completely engaged with each other in the fourth embodiment.
Figure 21:
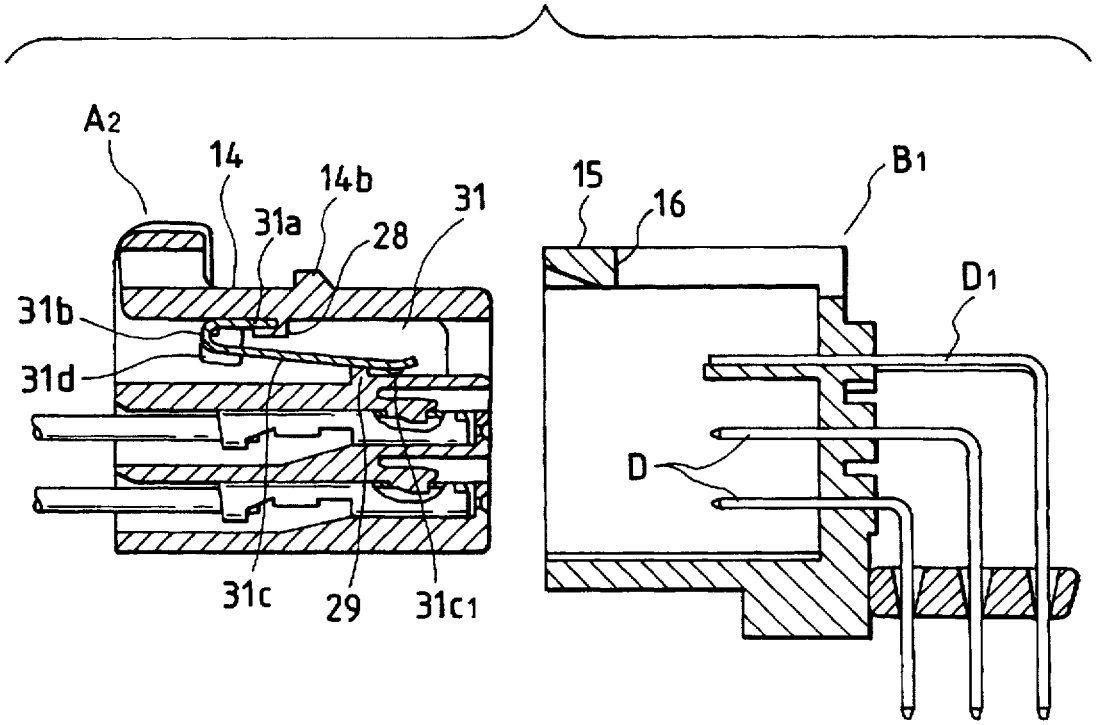
FIG. 21 is a sectional view showing another example of the connector assembly comprising male and female connector housings, which constitutes a fifth embodiment of the invention.
Figure 22:
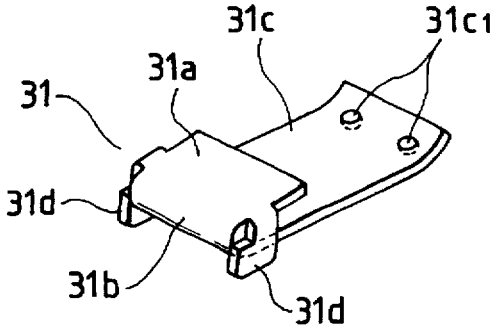
FIG. 22 is a perspective view of a shorting contactor in the fifth embodiment.
Figure 23:
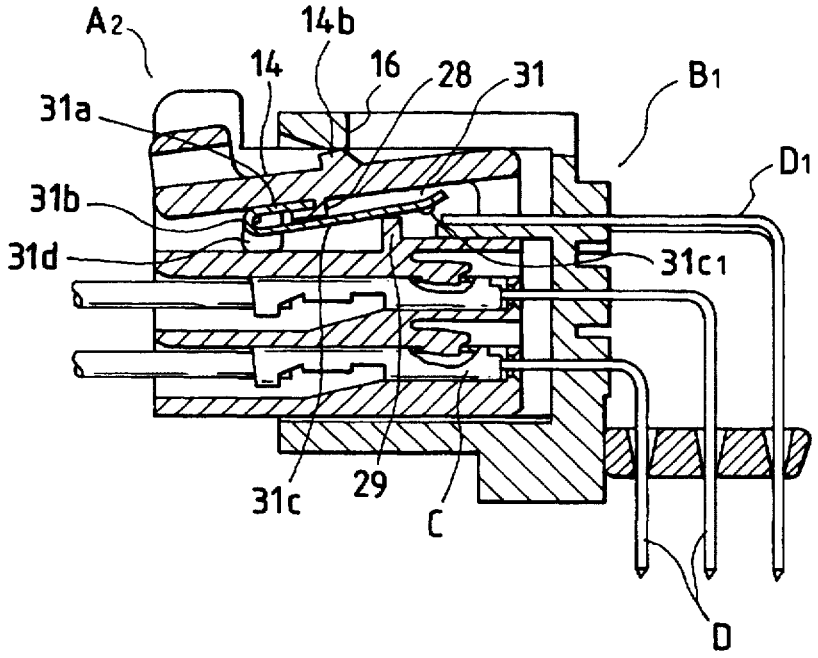
FIG. 23 is a sectional view showing the male and female connector housings which are incompletely engaged with each other in the fifth embodiment.
Figure 24:
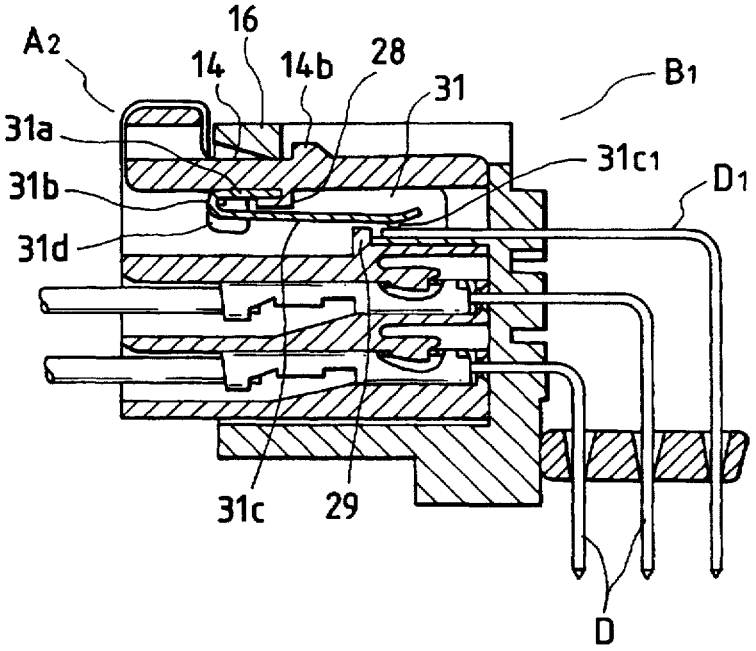
FIG. 24 is a sectional view showing the male and female connector housings which have been completely engaged with each other in the fifth embodiment.

When the connector housings $A_2$ and $B_1$ have been completely engaged with each other, the flexible locking arm 14 is restored, and the elastic contact plate 27*c* is also restored, so that the shorting contacts $27c_1$ are brought into contact with the pair of engagement detecting metal terminals $D_1$, thus activating the detecting electrical circuit (cf. FIG. 20).

Fifth Embodiment

FIGS. 21 through 24 show a fifth embodiment of the invention.

In the fifth embodiment, a shorting contactor 31 is formed by folding a piece of plate in such a manner that it is made up of a base plate 31*a*, and an elastic contact plate 31*c* which is coupled through a bent portion 31*b* to the base plate 31*a*. The base plate 31*a* has a pair of protective stoppers 31*d* on its both sides near the bent portion 31*b* which are extended beyond the elastic contact plate 31*c*. The elastic contact plate 31*c* has shorting contacts $31c_1$ at its free end portion.

The protective stoppers 31*d* function as follows: During engagement or disengagement of the connector housings $A_2$ and $B_1$, the protective stoppers 31*d* prevent the flexible locking arms 14 from being excessively displaced thereby to prevent the shorting contactor from deformation (cf. FIG. 23). Furthermore, the protective stoppers 31*d* prevent the shorting contactor 31 from being deformed by external force before the shorting contactor 31 formed is set in the connector housing $A_2$.

Sixth Embodiment

Figure 25:
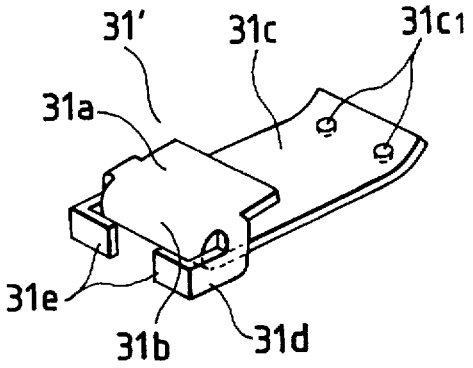
FIG. 25 is a perspective view of a shorting contactor in another example of the connector assembly comprising male and female connector housings, which constitutes a sixth embodiment of the invention.
Figure 26:
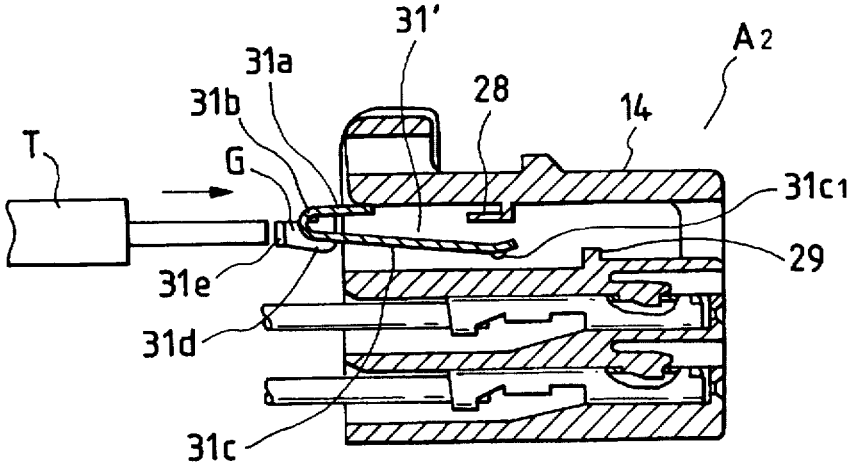
FIG. 26 is a sectional view showing the shorting contactor which is going to be set in the male connector housing in the sixth embodiment.
Figure 27:
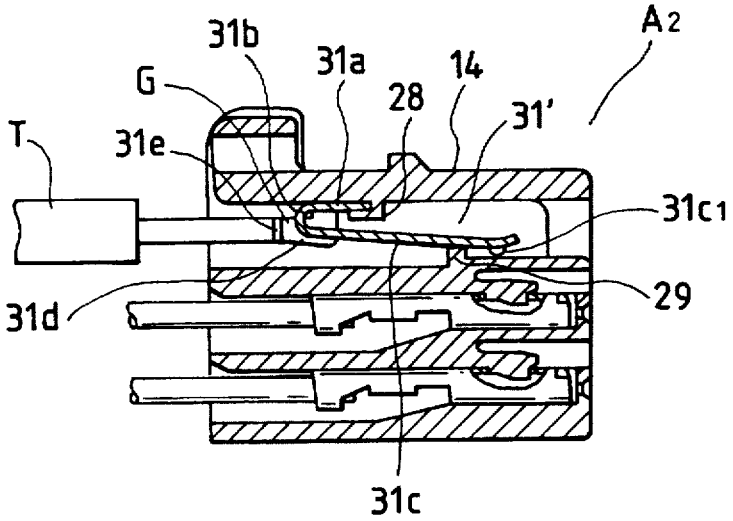
FIG. 27 is a sectional view showing the shorting contactor which has been set in the male connector housing in the sixth embodiment.

A sixth embodiment of the invention is as shown in FIGS. 25 through 27.

In the sixth embodiment, a shorting contactor 31' is formed by folding a piece of plate in such a manner that it is made up of a base plate 31*a*, and an elastic contact plate 31*c* which is coupled through a bent portion 31*b* to the base plate 31*a*. The elastic contact plate 31*c* has shorting contacts $31c_1$ at its free end portion. Moreover, the base plate 31*a* has a pair of protective stoppers 31*d* on its both sides near the bent portion 31*b*. The protective stoppers 31*d* are extended beyond the elastic contact plate 31*c*, thus providing a pair of protective receiving plates 31*e* which are spaced as much as G from the bent portion 31*b* (i.e., the protective receiving plates 31*e* and the bent portion 31*b* form gaps G between them).

As shown in FIGS. 26 and 27, in setting the shorting contactor 31' in the connector housing $A_2$, an inserting jig T is used. That is, the shorting contactor 31' is pressed into the connector housing $A_2$ through the protective receiving plates 31*e* with the jig T. In this operation, the elastic portions are prevented from being damaged by the jig T.

Seventh Embodiment

Figure 28:
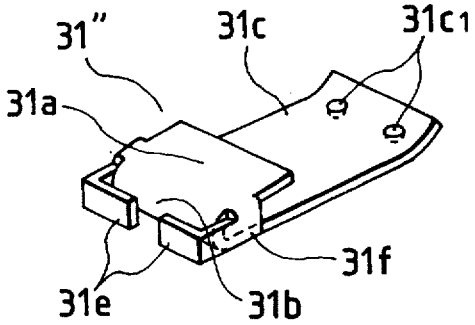
FIG. 28 is a perspective view of a shorting contactor in another example of the connector assembly comprising male and female connector housing, which constitutes a seventh embodiment of the invention.
Figure 29:
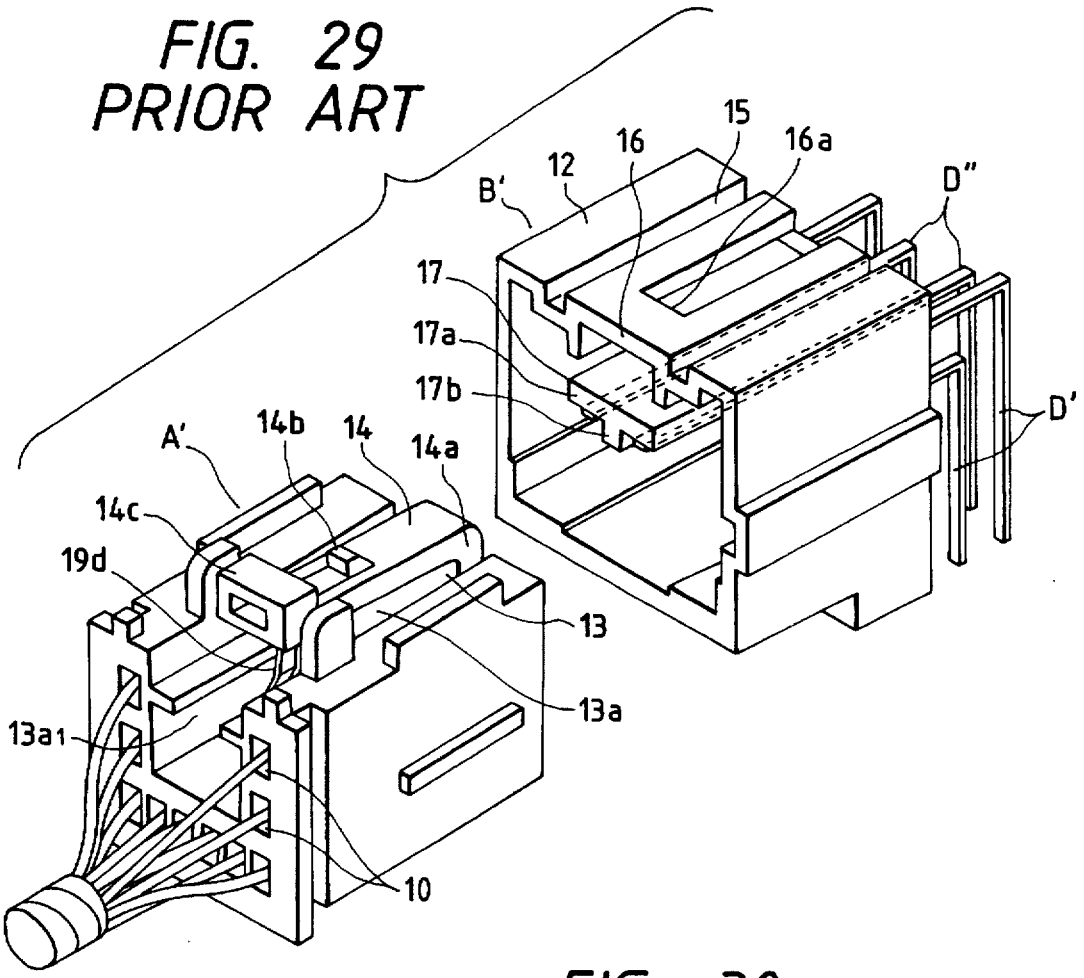
FIG. 29 PRIOR ART
FIG. 29 is an exploded perspective view of a conventional connector assembly comprising male and female connector housings.
Figure 30:
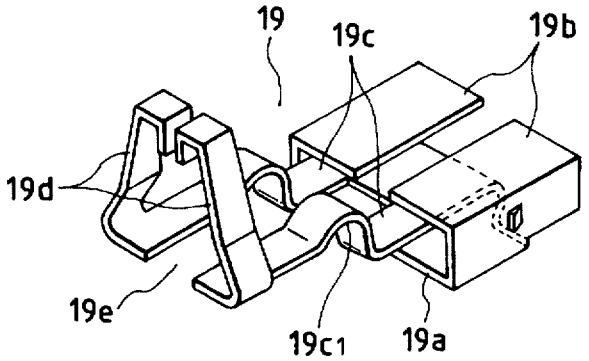
FIG. 30 PRIOR ART
FIG. 30 is a perspective view of a shorting contactor in the conventional connector assembly.
Figure 31:
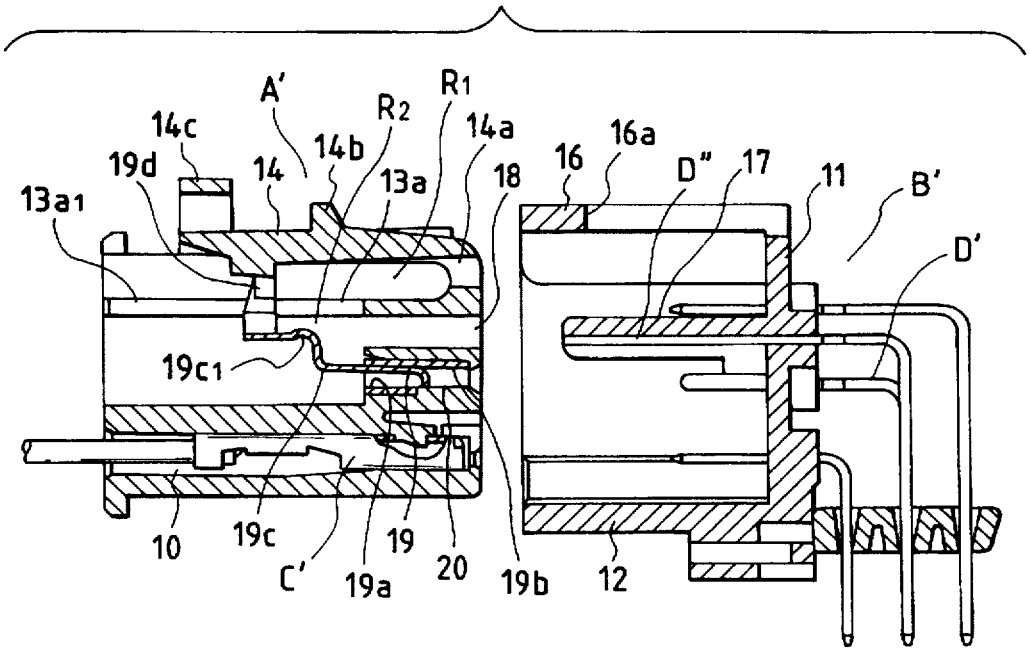
FIG. 31 PRIOR ART
FIG. 31 is a sectional view of the male and female connector housings in the conventional connector assembly.
Figure 32:
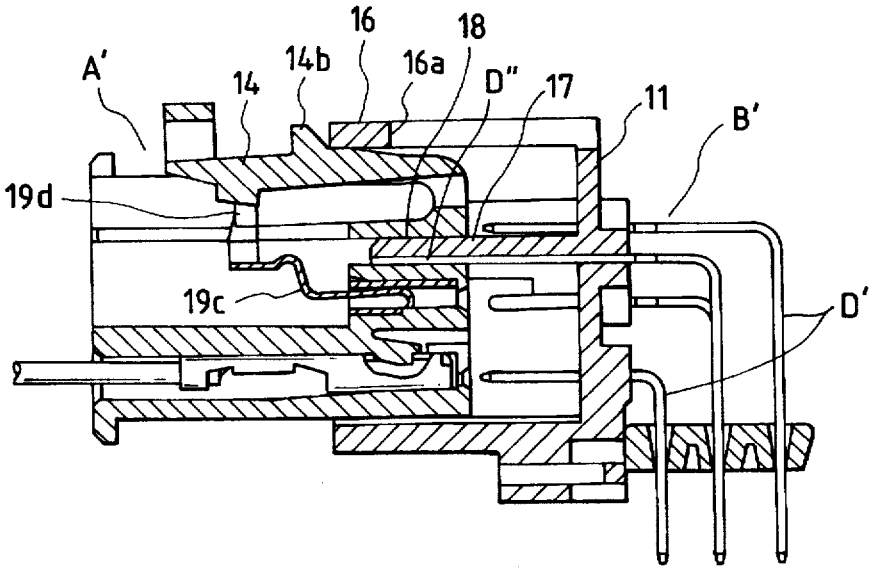
FIG. 32 PRIOR ART
FIG. 32 is a sectional view showing the male and female connector housings which are going to be engaged with each other in the conventional connector assembly.
Figure 33:
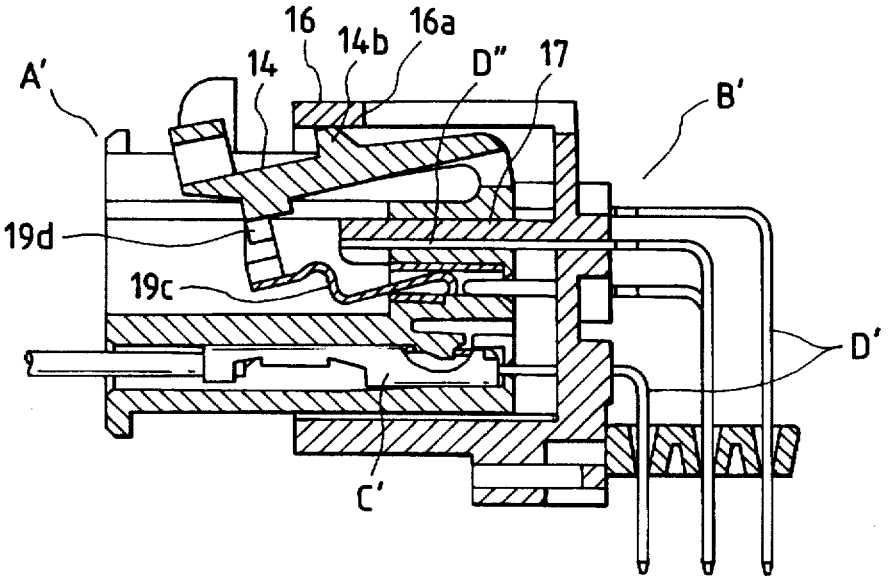
FIG. 33 PRIOR ART
FIG. 33 is a sectional view showing the male and female connector housings which are incompletely engaged with each other in the conventional connector assembly.
Figure 34:
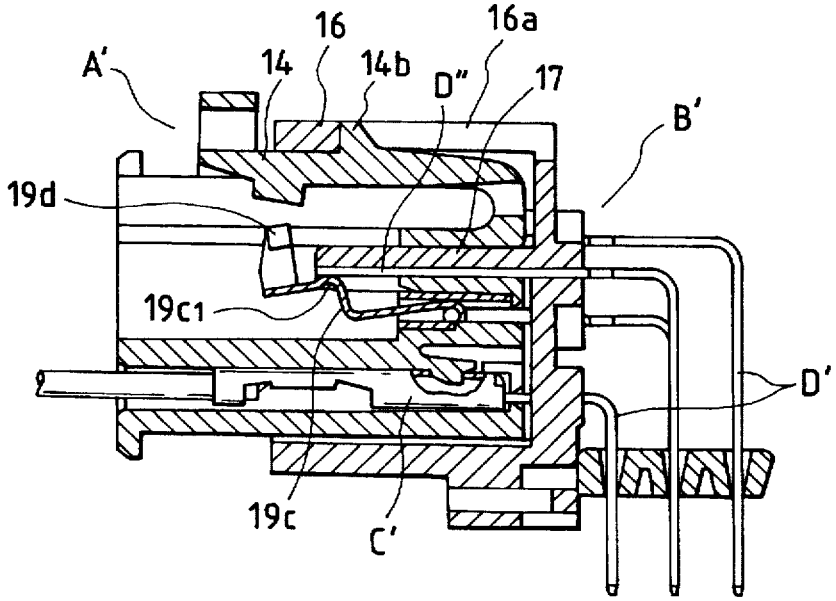
FIG. 34 PRIOR ART
FIG. 34 is a sectional view showing the male and female connector housings which have been completely engaged with each other in the conventional connector assembly.

FIG. 28 is a view for a description of an eighth embodiment of the invention.

In the seventh embodiment, a shorting contactor 31" is formed by folding a piece of plate. More specifically, the shorting contactor 31" is made up of a base plate 31*a*, and a bent portion 31*b* which is extended from the base plate 31*a*. The base plate 31*a* has a pair of coupling plates 31*f* on its both sides near the bent portion 31*b*. The coupling plates 31*f* are extended outwardly of the bent portion 31*b*, thus providing a pair of protective receiving plates 31*e* which are spaced from the bent portion 31*b*.

In the connector engagement detecting device of the invention, the shorting contactor is set in the displacement permitting space provided for the flexible locking arm in such a manner that the elastic contact plate is moved into or out of engagement with the engagement detecting metal terminals. This feature makes it possible to set the shorting contactor at the same level as the flexible locking arm, miniaturizing the connector assembly of this type.

What is claimed is:

1. A connector engagement detecting device comprising:

a first connector housing having a flexible locking arm;

a shorting contactor set in a displacement permitting space provided for said flexible locking arm in said first connector housing, said shorting contactor including an elastic contact plate having a front and rear end, which is displaced in association with displacement of said flexible locking arm;

a second connector housing having an engaging section provided for said flexible locking arm; and a pair of engagement detecting metal terminals provided in said second connector housing in confrontation with the front end of said elastic contact plate of said shorting contactor, wherein when said first and second connector housings are incompletely engaged with each other, said shorting contactor is prevented from being in contact with said engagement detecting metal terminals by displacement of said front end of said elastic contact plate of said shorting contactor in an upward direction within the displacement permitting space, which is due to the displacement of said flexible locking arm in a downward direction.

2. The connector engagement detecting device as claimed in claim 1, wherein said shorting contractor includes a base plate, and said elastic contact plate is provided over said base plate through a bent portion in such a manner that the front end of said elastic contact plate is extended beyond said bent portion, wherein the front end of said elastic contact plate has shorting contacts formed thereon and said elastic contact plate has a pair of mounting ears at a base end thereof, extending toward said base plate.

3. The connector engagement detecting device as claimed in claim 2, wherein said shorting contacts on said elastic contact plate are provided in such a manner that said shorting contacts are able to go in and out of an accommodating chamber formed in said first connector housing in such a manner that said chamber is opened in a front end face of said first connector housing, said shorting contacts being brought into contact with said engagement detecting metal terminals when caused to go into said accommodating chamber.

4. The connector engagement detecting device as claimed in claim 1, wherein said shorting contactor has a Z-shape and includes a base plate, an elastic plate which is provided over said base plate through a first bent portion, and said elastic contact plate which is provided over said elastic plate through a second bent portion in such a manner that said elastic contact plate is extended beyond said first bent portion, said elastic contact plate having shorting contacts wherein said shorting contacts are displaced in an upward direction when said second bent portion is displaced in a downward direction.

5. The connector engagement detecting device as claimed in claim 4, wherein said second bent portion includes a raised driven portion.

6. The connector engagement detecting device as claimed in claim 4, wherein said pair of engagement detecting metal terminals of said second connector housing enter the displacement permitting space provided for said flexible locking arm in said first connector housing.

7. The connector engagement detecting device as claimed in claim 1, wherein said shorting contactor includes a base plate, said elastic contact plate being provided under said base plate through a bent portion, said base plate being locked to an upper inner surface of said flexible locking arm, and the front end of said elastic contact plate has shorting contacts formed thereon, said base plate being abutted against a fulcrum member formed on a bottom surface of a recess of the displacement permitting space in said first connector housing, so that said shorting contactor is swung about said fulcrum member.

8. The connector engagement detecting device as claimed in claim 7, wherein said base plate of said shorting contactor has protective stoppers on both sides near said bent portion in such a manner that said protective stoppers extend below said elastic contact plate.

9. The connector engagement detecting device as claimed in claim 7, wherein said base plate of said shorting contactor has protective receiving plates on both sides near said bent portion in such a manner that said protective receiving plates are spaced from said bent portion.

10. The connector engagement detecting device as claimed in claim 7, wherein said pair of engagement detecting metal terminals of said second connector housing enter the displacement permitting space provided for said flexible locking arm in said first connector housing.

11. A connector engagement detecting device, comprising:

a first connector housing having a flexible locking arm;

a shorting contactor set in a displacement permitting space provided for the flexible locking arm in said first connector housing, said shorting contactor including an elastic contact plate which is displaced in association with displacement of the flexible locking arm;

a second connector housing having an engaging section provided for the flexible locking arm; and a pair of engagement detecting metal terminals provided in said second connector housing in confrontation with said shorting contactor, wherein when said first and second connector housings are incompletely engaged with each other, said shorting contactor is prevented from being in contact with said engagement detecting metal terminals by displacement of the elastic contact plate of said shorting contactor which is due to the displacement of said flexible locking arm, wherein said shorting contactor includes a base plate, and an elastic contact plate which is provided over said base plate through a bent portion in such a manner that said elastic contact plate is extended beyond said bent portion to have shorting contacts, said base plate being extended beyond said bent portion, thus providing a clamping plate.

12. The connector engagement detecting device as claimed in claim 11, wherein when said first and second connector housings are engaged with each other, said clamping plate of said shorting contactor is abutted through a receiving portion thereof against an electrically insulating supporting plate provided for said engagement detecting metal terminals, while said shorting contacts are abutted against said engagement detecting metal terminals.

* * * * *